US006373384B1

(12) United States Patent
Ferguson et al.

(10) Patent No.: US 6,373,384 B1
(45) Date of Patent: Apr. 16, 2002

(54) INFLATABLE SECURITY DEVICE

(76) Inventors: Gary William Ferguson, 4806 Fernglen Drive, Burnaby, British Columbia (CA), V6G 3V7; Branko Palcic, 3758 Quesnel Street, Vancouver, British Columbia (CA), V6L 2W8

( * ) Notice: Subject to any disclaimer, the term of this patent is extended or adjusted under 35 U.S.C. 154(b) by 0 days.

(21) Appl. No.: 09/551,308

(22) Filed: Apr. 18, 2000

(51) Int. Cl.[7] ..... G08B 21/00

(52) U.S. Cl. ..... 340/540; 340/573.1; 340/691.1; 340/693.5; 116/210

(58) Field of Search ..... 340/540, 573.1, 340/574, 691.1, 691.7, 693.5, 321; 116/210, DIG. 7, DIG. 8, DIG. 9

(56) References Cited

U.S. PATENT DOCUMENTS

| | | | | | |
|---|---|---|---|---|---|
| 4,042,882 | A | * | 8/1977 | Camacho et al. | 325/118 |
| 4,068,739 | A | | 1/1978 | Gordon et al. | 182/139 |
| 4,102,296 | A | | 7/1978 | Felix | 116/124 B |
| 4,152,891 | A | | 5/1979 | Garner | 60/205 |
| 4,186,851 | A | | 2/1980 | Cantor | 222/113 |
| 4,586,456 | A | * | 5/1986 | Forward | 116/210 |
| 4,821,024 | A | * | 4/1989 | Bayha | 340/545 |
| 4,872,414 | A | * | 10/1989 | Asquith et al. | 116/210 |
| 4,920,674 | A | * | 5/1990 | Shaeffer | 40/412 |
| 4,965,552 | A | | 10/1990 | Price et al. | 340/566 |
| 5,030,152 | A | * | 7/1991 | Carr et al. | 441/89 |
| 5,039,162 | A | | 8/1991 | Yoshida | 297/216 |
| 5,083,708 | A | | 1/1992 | Walters | 239/55 |
| 5,083,771 | A | * | 1/1992 | Tyner | 272/27 |
| 5,108,337 | A | * | 4/1992 | Sloan et al. | 446/220 |
| 5,111,968 | A | | 5/1992 | Wilkerson | 222/47 |
| 5,301,631 | A | * | 4/1994 | Vining | 116/210 |
| 5,366,118 | A | | 11/1994 | Ciammitti et al. | 222/153 |
| 5,367,294 | A | | 11/1994 | Brown | 340/692 |
| 5,403,222 | A | * | 4/1995 | Koenig et al. | 446/220 |
| 5,487,561 | A | | 1/1996 | Mandzy et al. | 280/741 |
| 5,597,179 | A | | 1/1997 | Kornhauser | 280/735 |
| 5,710,543 | A | * | 1/1998 | Moore | 340/691 |
| 5,785,348 | A | | 7/1998 | Donovan et al. | 280/740 |
| 5,890,736 | A | | 4/1999 | Sides et al. | 280/738 |
| 6,164,239 | A | * | 12/2000 | Dawson | 116/210 |

* cited by examiner

*Primary Examiner*—Daniel J. Wu
*Assistant Examiner*—Phung T Nguyen
(74) *Attorney, Agent, or Firm*—Kolisch Hartwell Dickinson McCormack & Heuser

(57) ABSTRACT

A deterrent device comprises a portable container having a cavity disposed therein and an actuator mechanism disposed within the cavity. An inflatable deterrent extends outwardly from the actuator mechanism, the inflatable deterrent is substantially contained within the cavity in a non-operative configuration. The actuator mechanism is activated by an operator to attain an operative configuration in which the actuator mechanism inflates the inflatable deterrent outwardly from the container, an assailant being deterred by the inflated inflatable deterrent.

10 Claims, 3 Drawing Sheets

INFLATABLE SECURITY DEVICE

BACKGROUND OF THE INVENTION

1. Field of the Invention

The invention relates generally to inflatable bladders, more particularly to a portable inflatable device that may be used as a deterrent.

2. Description of Related Art

Air bags are well known as safety devices and have found wide application to protect a human from impact injuries. In contrast to restraining devices, for example seat belts, air bags offer substantially greater protection.

Conventionally, an air bag is connected to a source of gas and a trigger mechanism that causes the gas to be discharged into the bag upon activation of the trigger. However, there exist applications where it is desirable for the bag to be free-standing, lightweight and mobile, having a mode of inflation, a trigger mechanism and the bag, all integrated within a carrier. Such free-standing air bags may be particularly suitable as inflatable security devices for use as crime deterrents, animal deterrents or in military/law enforcement.

Numerous applications disclosing designs and mechanisms for activation and deployment of security devices exist, including: U.S. Pat. No. 4,068,739 granted on Jan. 17, 1978 to Donald W. Gordon et al. for a "Disaster Evacuation Air Cushion", U.S. Pat. No. 4,102,296 granted on Jul. 25, 1978 to Harold E. Felix for a "Marine Safety Signal Device", U.S. Pat. No. 5,039,162 granted on Aug. 13, 1991 to Tokuichiro Yoshida for a "Chair Serving as a Safety Device", U.S. Pat. No. 4,152,891 granted on May 8, 1979 to Eugene F. Garner for a "Pyrotechnic Composition and Method of Inflating an Inflatable Automobile Safety Restraint", U.S. Pat. No. 5,367,294 granted on Nov.22, 1994 to Edwin B. Brown for an "Inflatable Security Mannequin", U.S. Pat. No. 5,487,561 granted to John Mandzy et al for a "Safety Bag Inflation Apparatus Using a Liquid Propellant Gas Generator", U.S. Pat. No. 5,351,988 granted on Oct. 4, 1994 to Robert J. Bishop et al. for "Hybrid Inflator with Staged Inflation Capability", U.S. Pat. No. 5,597,179 granted on Jan. 28, 1997 to Murray Cornhouser for an "Air Bag Inflation Devices and Methods", U.S. Pat. No. 5,785,348 granted on Jul. 28, 1998 to Steven P. Donavan for a "Diffuser Cup for an Inflator Device Which is Used to Inflate an Air Bag in an Air Bag System", U.S. Pat. No. 5,890,736 granted on Apr. 6, 1999 to James R. Sydes for an "Aspiration-type Air Bag Inflation Apparatus", U.S. Pat. No. 4,186,851 granted on Feb. 5, 1980 to Burton M. Cantor for a "Non-lethal Personal Defense Weapon", U.S. Pat. No. 4,965,552 granted on Oct. 23, 1990 to Charles S. Price et al. for an "Electronic Annular Repellent Apparatus", U.S. Pat. No. 5,083,708 granted on Jan. 28, 1992 to Gerald A. Walters for a "Wildlife Repellent Unit" and U.S. Pat. No. 5,111,968 granted on May 12, 1992 to William E. Wilkinson for "Canisters for Pressurized Gas and Personal Security Devices Utilizing Same".

However, the air bag devices suffer from a number of important disadvantages. Oftentimes air bags are fully integrated within a carrier vehicle, for example a motor vehicle, and are inflated upon an impact force. Many air bags have elaborate electronic sensing devices that are activated to deploy the bag upon impact.

Thus, there is a need for a free-standing, compact, lightweight, mobile air bag that may be used as a deterrent, for example against animal attacks.

SUMMARY OF THE INVENTION

The invention reduces the difficulties and disadvantages of the prior art by providing a simple portable inflatable deterrent device that can be manufactured inexpensively from readily available materials. The device provides a lightweight means of deterring an assailant that is free-standing, portable, and may be adapted to be reusable. In addition, the device has a novel means of dispensing a chemical repellent into or over the inflatable bladder to deter the assailant.

In one aspect, the invention provides a deterrent device comprising a portable container having a cavity disposed therein; an actuator mechanism disposed within the cavity; and an inflatable deterrent extending outwardly from the actuator mechanism, the inflatable deterrent being substantially contained within the cavity in a non-operative configuration, the actuator mechanism being activated by an operator to attain an operative configuration in which the actuator mechanism inflates the inflatable deterrent outwardly from the container, an assailant being deterred by the inflated inflatable deterrent.

In another aspect, the invention provides a container opening through which the inflatable deterrent moves to attain the operative configuration; and a moveable cover located to cover the exit opening in the non-operative configuration, the cover being moveable away from the exit opening in the operative configuration.

In yet another aspect, the invention provides the actuator mechanism having an inflator connected to the inflatable deterrent; and a trigger interfaced with a delay timer, the trigger being activatable by the operator, the trigger being positioned within a recess so as to reduce accidental activation by the operator, the trigger being in communication with the inflator.

In another aspect, the invention provides a compressed gas source in communication with the inflatable deterrent, the compressed gas being released upon activation of the trigger, the compressed gas inflating the inflatable deterrent.

In another aspect, the invention provides a source of chemical repellent in communication with the actuator mechanism, the chemical repellent being released during activation of the actuator mechanism by the operator, the chemical repellent being dispersed so as to coat or fill the inflatable deterrent. The source of chemical repellent is in communication with the inside of the inflatable bladder, the chemical repellent being released into the inflatable deterrent upon activation of the actuator mechanism by the operator, so as to substantially fill the inflatable bladder, the chemical repellent being released outwardly when the assailant penetrates the inflatable bladder.

BRIEF DESCRIPTION OF THE DRAWINGS

In drawings which illustrate embodiments of the invention.

DETAILED DESCRIPTION OF THE PREFERRED EMBODIMENTS

Figure 1:
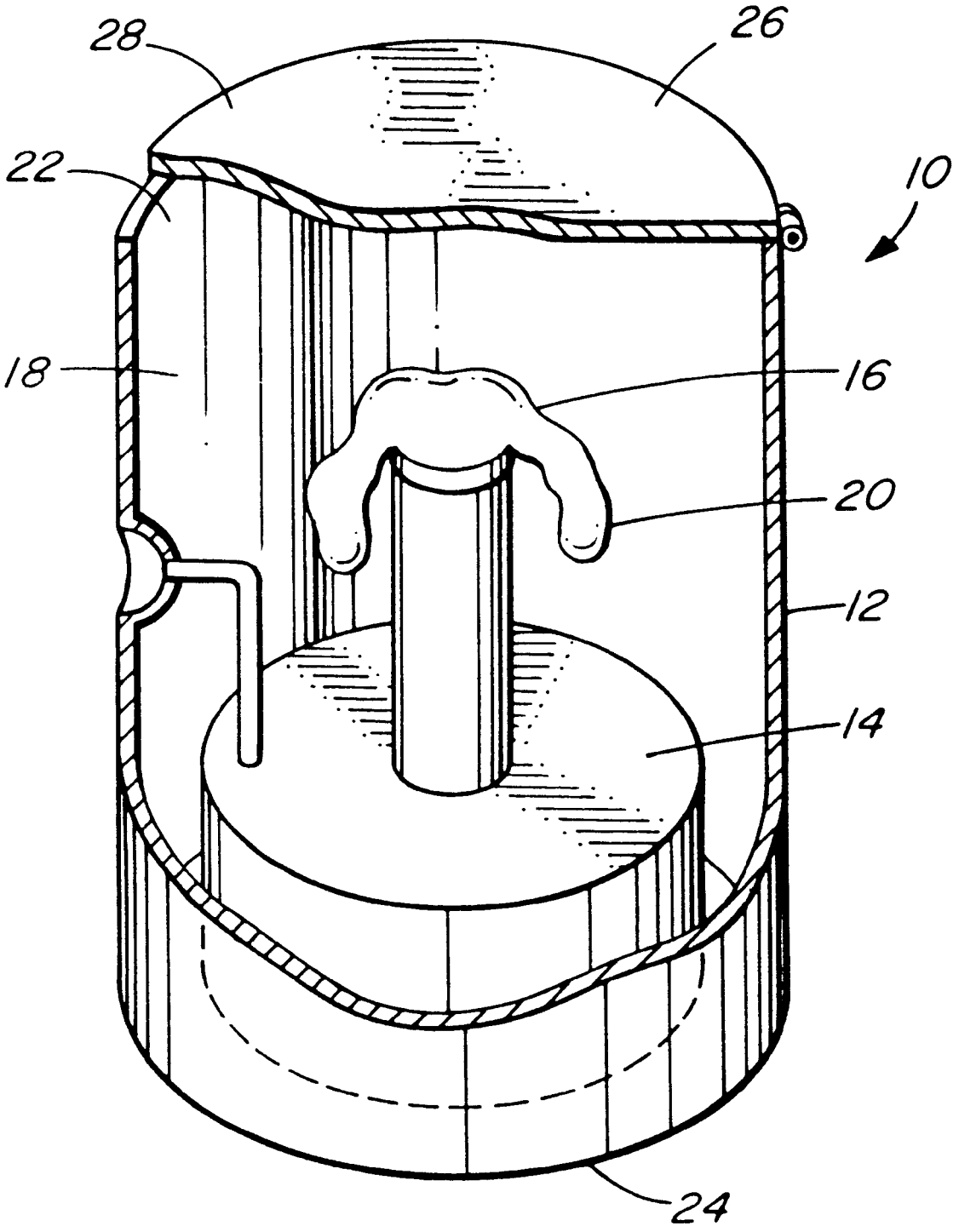
FIG. 1 is a partial cross-sectional elevational view of a first embodiment of the invention showing a deflated bladder stored in a container.

FIG. 1 shows a first embodiment according to the invention of a portable inflatable device 10 in a non-operative configuration. The device 10 may be used as a deterrent against an assailant. Encounters with wild animals by campers, hikers, and guides are not uncommon. The device 10 may be used as a deterrent against attacks by wild animals.

The deterrent device 10 comprises a portable container 12, an actuator mechanism 14 and an inflatable deterrent 16. The portable container 12 has a cavity 18 disposed therein and is constructed from a lightweight material that allows a user to easily transport the device 10. Typical materials for construction of the container 12 may include aluminum, stainless steel, and a resilient plastic. The actuator mechanism 14 is located within the cavity 18 and may be secured therein using conventional securing means. The inflatable deterrent 16 is substantially contained within the cavity 18 in the non-operative configuration.

Figure 2:
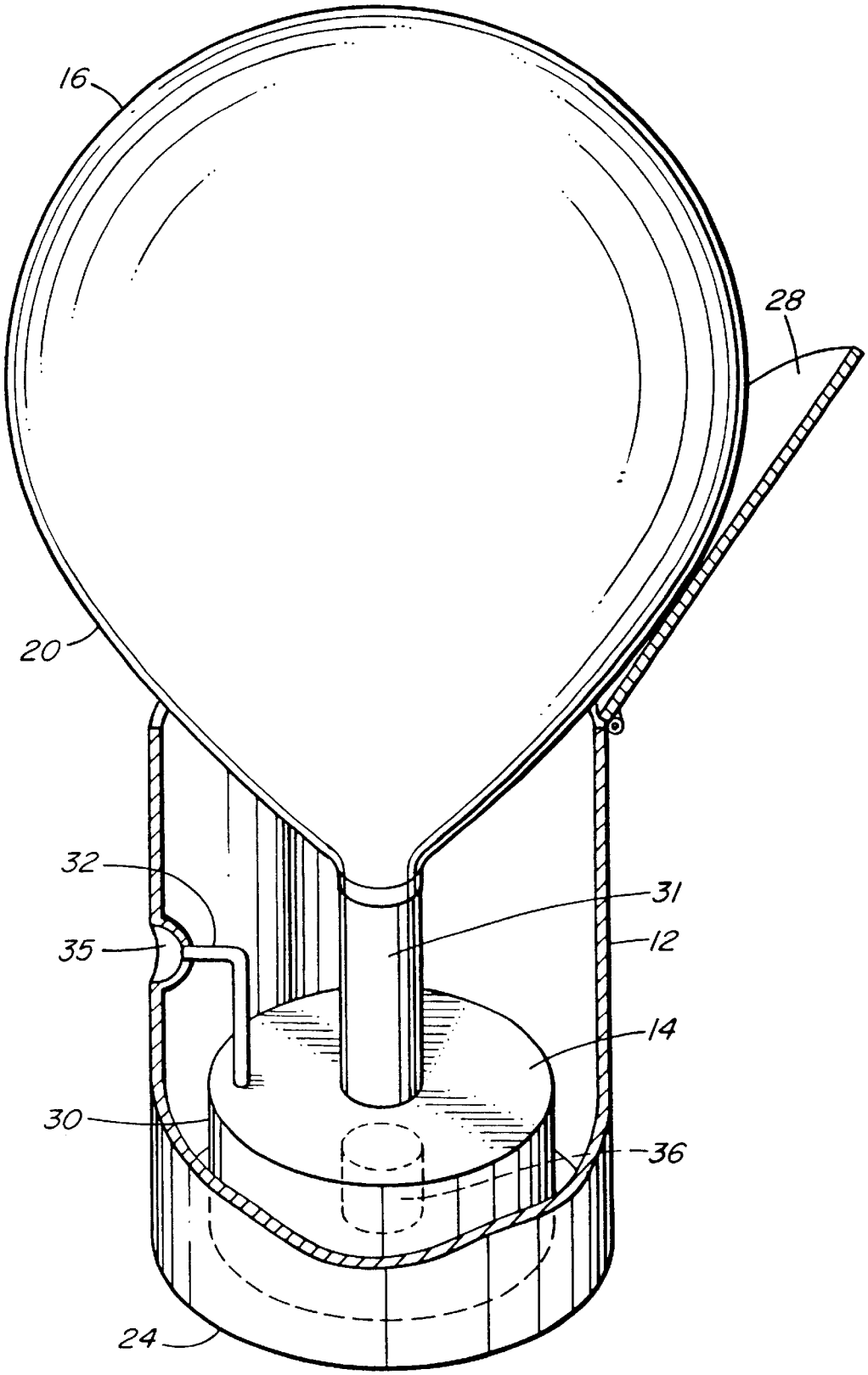
FIG. 2 is a fragmentary view of the first embodiment of the invention showing an inflated bladder.

FIG. 2 shows the device in an operative configuration. The inflatable deterrent 16 is connected to the actuator mechanism 14 and may be operated by an operator such that the actuator mechanism 14 inflates the inflatable deterrent 16 outwardly from the container 12. This outward inflation serves to deter the assailant. The inflatable deterrent 16 may be constructed from a resilient material in the form of a bladder 20. The bladder 20 may be composed of thin nylon and may include reinforcing threads. The bladder 20 may be of a size, shape, or color to maximize the intimidation factor. Shapes may be painted on the surface which also may be selected to maximize the intimidation factor.

The portable container 12 has an opening 22 which may be located a sufficient distance away from a base 24 and the actuator mechanism 14 to allow the inflatable deterrent 16 to move therethrough to attain the operative configuration. As best seen in FIG. 1, the container opening 22 may have a moveable cover 26 located to cover the container opening 22 in the non-operative configuration. The cover 26 is moveable away from the container opening 22 during operation of the deterrent device 10 to attain the operative configuration. The moveable cover 26 may comprise a lid 28 that may be hingeably mounted to the rim of the container opening 22 and mounted adjacent thereto. In the non-operative configuration the lid 28 may be located in a fully closed position, with sufficient space between the deflated bladder 20 and the lid 28 to allow for efficient inflation. During inflation, the inflatable deterrent 16 may force against the lid 28 thereby opening it and allowing the bladder 20 to expand outwardly therethrough and away from the container 12 and the actuator mechanism 14. One skilled in the art will recognize that many other release mechanisms, including a "pop top" release mechanism, are available to implement aspects of the invention. It is envisaged that the portable container 12 may comprise two halves that may separate upon activation to allow the inflatable deterrent 16 to expand outwardly from one portion of the separated container 12.

The actuator mechanism 14 may comprise an inflator 30 and a trigger 32. The inflator 30 may be connected to the inflatable deterrent 16 by a dispensing tube 31. The trigger 32 may be located within a recess 35 in the external surface of the container 12 so as to be protected from the assailant and to prevent inadvertent activation of the device 10 by the operator. The trigger 32 is located to be in communication with the inflator 30.

A source of compressed gas 36 contained in the inflator 30 may be in communication with the inflatable deterrent 16. The compressed gas may be released upon activation of the trigger 32 such that the inflatable deterrent 16 is inflated by the compressed gas. The compressed gas source 36 may be removable by the operator once the gas has been dispensed and may be recharged for re-use. The compressed gas source 36 may also include gas-generating components which may be combined to produce a gas upon activation by the trigger 32 by the operator.

ALTERNATIVES

The first embodiment of the invention is shown for use as a visual deterrent of an assailant. The deterrent device 10 may also be modified to include a means of deploying a chemical repellent into or over the inflatable bladder 20 once the trigger 32 is activated.

Figure 3:
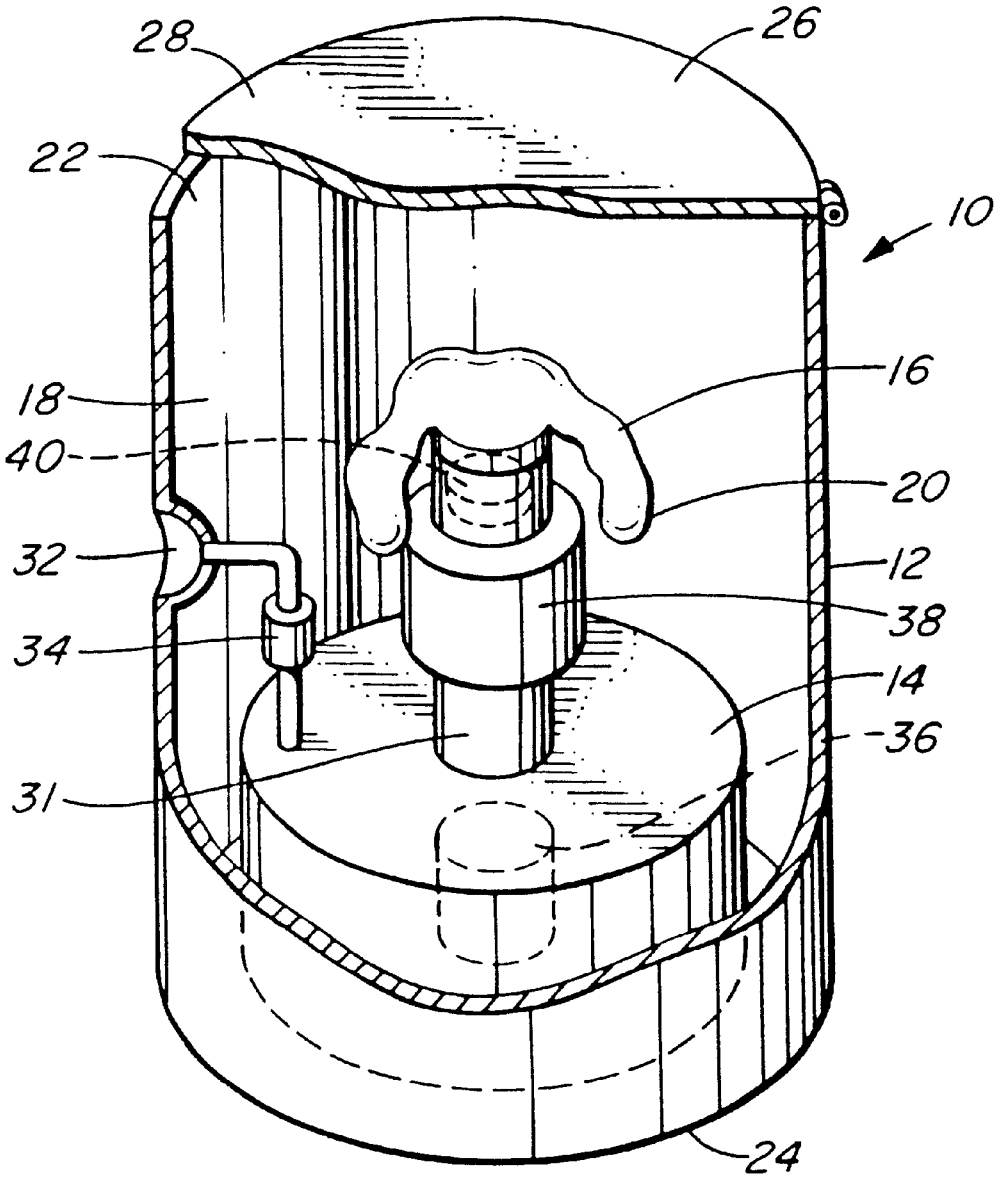
FIG. 3 is a simplified view of an alternative embodiment of the invention showing a container for a chemical repellent.

FIG. 3 shows a source of chemical repellent 38 that may be in communication with the actuator mechanism 14. The chemical repellent is released upon activation of the actuator mechanism 14 by the operator. The chemical repellent may be dispersed so as to coat or fill the inflatable deterrent 16. Such chemical repellents may include smoke, dye, or other irritants. The source of chemical repellent 38 may also be in communication with the inside of the inflatable bladder 20. The chemical repellent may be released into the inflatable deterrent 16 upon activation of the actuator mechanism 14 by the operator and may fill a substantial portion of the bladder 20. Upon perforation of the bladder 20 by the assailant, for example, a wild animal, the chemical repellent may be released outwardly so as to contact the assailant and repel it.

Deterrents in the form of a noise maker 40, located in the dispensing tube 31 may also be connected to the actuator mechanism 14. The noise maker 40 may also be activated by the operator and may be capable of generating a noise of sufficient loudness so as to deter the assailant. Such noise makers may include whistles or explosives.

The trigger 32 may be additionally interfaced with a delay timer 34 which may allow remote and delayed inflation of the bladder 20. The delay timer 34 may be used with visual or sound warning devices such as flashing lights or a "beeper" that would alert the operator to the impending inflation of the bladder 20.

Pyrotechnic ignition of a liquid propellant and potentially a sound charge (explosive or whistle may be incorporated into the timed discharge of the bladder 20.

The bladder 20 may additionally be used to protect the occupant of a home. The inflated bladder 20 may complicate entry of a housebreaker or if used in conjunction with a dye-stuff or irritating chemical may mark or disable the perpetrator of a crime. The device may be incorporated into other electronic security measures.

Tear gas, flash grenades and smoke have been employed by enforcement agencies in conflict and hostage situations. The device 10 may provide a well-controlled curtain to obscure view or discourage the use of weapons, since these would pierce the bladder 20 and expose the assailant to the chemical irritants enclosed therein. Bladder size and coloration may be chosen to create a disorienting field and with appropriate selection of materials, a temporary and highly resistant shield may be erected.

Operation

The device 10 is usually supplied to the user in the inoperative configuration as shown in FIG. 1 with the bladder 20 fully deflated and the lid 28 in a fully closed position. Referring to FIGS. 1 and 2, upon an encounter with an assailant the operator may activate the trigger 32 which may send a signal to the compressed gas source 36 so that the gas is released through the dispenser tube 31 and into the deflated bladder 20 causing it to inflate rapidly and outwardly. This rapid and outward inflation of the bladder 20 forces upwardly against the lid 28 causing it to open. The bladder 20 expends outwardly through the opening 22 in a manner so as to deter the assailant. Simultaneously, if required, the chemical repellent source 38 dispenses the chemical repellent over the surface of the bladder 20 and may additionally dispense the repellent outwardly away from the bladder 20 so as to deter the assailant.

Thus, in summary the device 10 acts as an inflatable deterrent by obscuring the view of the assailant or by intimidation, including size, shape, noise and the use of dispensable irritants.

While specific embodiments of the invention have been described and illustrated, such embodiments should be considered illustrative of the invention only and not as limiting the invention as construed in accordance with the accompanying claims.

What is claimed is:

1. A deterrent device, comprising:

a) a portable unitary container having a cavity disposed therein and an opening at a first end;

b) an actuator mechanism within the cavity;

c) an inflatable deterrent connected to the actuator mechanism and extendable outwardly from the actuator mechanism, the inflatable deterrent being contained within the cavity in a non-operative configuration;

d) a trigger in communication with the actuator mechanism via a delay timer and positioned within a recess so as to reduce the risk of accidental activation by the operator, the trigger being activatable to inflate the inflatable deterrent outwardly from the container into an operable configuration to deter an assailant;

e) a moveable cover to cover the opening in the non-operative configuration, the cover opening automatically due to the inflation of the inflatable deterrent.

2. The device as claimed in claim 1 in which the moveable cover is a lid hingeably mounted adjacent the opening.

3. The device as claimed in claim 1 in which the actuator mechanism is mounted to a container wall, the actuator mechanism being located to provide an unobstructed path of inflation for the inflatable deterrent.

4. The device as claimed in claim 1 in which the actuator mechanism comprises a compressed gas source in communication with the inflatable deterrent, the compressed gas being released upon activation of the trigger to inflate the inflatable deterrent.

5. The device as claimed in claim 1 in which the trigger is activated remotely by the operator.

6. The device as claimed in claim 1 further comprising a source of chemical repellent in communication with the actuator mechanism, the chemical repellent being released during activation of the actuator mechanism by the operator, and dispersed so as to coat the inflatable deterrent.

7. The device as claimed in claim 6 in which the source of chemical repellent is in communication with the inside of the inflatable deterrent, the chemical repellent being released into the inflatable deterrent upon activation of the actuator mechanism by the operator so as to substantially fill the inflatable deterrent, the chemical repellent being released outwardly when the assailant penetrates the inflatable deterrent.

8. The device as claimed in claim 1 in which a noise maker is connected to the actuator mechanism, the noise maker being activated when the operator activates the actuator mechanism and the noise maker being capable of generating a noise of sufficient loudness to further deter the assailant.

9. The device as claimed in claim 1 in which an operator feedback is configured with the delay timer, the operator feedback being capable of generating a signal to alert the operator that the delay timer has been activated.

10. The device as claimed in claim 9 in which the signal is a beeper or a flashing light.

* * * * *